US006817739B2

(12) United States Patent
Blateri

(10) Patent No.: US 6,817,739 B2
(45) Date of Patent: Nov. 16, 2004

(54) ELECTRICAL LIGHT ASSEMBLY, ADAPTER AND METHOD

(76) Inventor: Frank Blateri, 191 Chaucer Ct., Coppell, TX (US) 76019

( * ) Notice: Subject to any disclaimer, the term of this patent is extended or adjusted under 35 U.S.C. 154(b) by 0 days.

(21) Appl. No.: 10/403,728

(22) Filed: Mar. 31, 2003

(65) Prior Publication Data

US 2004/0190301 A1 Sep. 30, 2004

(51) Int. Cl.[7] ..... F21V 17/06

(52) U.S. Cl. ..... 362/453; 362/351; 362/353; 362/437; 362/439

(58) Field of Search ..... 362/353, 226, 362/439, 430, 453, 437, 433, 351

(56) References Cited

U.S. PATENT DOCUMENTS

| | | | | | |
|---|---|---|---|---|---|
| 3,849,640 | A | * | 11/1974 | McCarthy | 362/437 |
| 4,633,378 | A | * | 12/1986 | Reisman | 362/353 |
| 5,993,029 | A | * | 11/1999 | Chambers | 362/363 |
| 6,338,565 | B1 | * | 1/2002 | Fager et al. | 362/363 |
| 6,631,999 | B1 | * | 10/2003 | Chang | 362/96 |
| 6,655,821 | B1 | * | 12/2003 | Tai | 362/353 |

* cited by examiner

*Primary Examiner*—Laura K. Tso
(74) *Attorney, Agent, or Firm*—Haynes and Boone, LLP.

(57) ABSTRACT

An electrical light assembly, adapter and method in which an internally threaded base member of an adapter is threaded to an externally threaded member of an electrical socket, and a plurality of angularly-spaced ribs extending from the base member are inserted through an opening in the shade to establish a force fit.

23 Claims, 2 Drawing Sheets

ELECTRICAL LIGHT ASSEMBLY, ADAPTER AND METHOD

BACKGROUND

This invention relates to an electrical light assembly including an adapter for connecting a light shade to an electrical socket.

Light shades, usually in the form of glass or plastic members, are often used to extend around a light bulb to eliminate glare from the bulb and to add aesthetic appeal. For example, various light fixtures and ceiling fans often include one or more lights which include an electrical socket for receiving a bulb and a glass shade that is connectable to the socket. However, it is often difficult to connect the light shade to the socket without damaging or breaking the shade.

Therefore, what is needed is an adapter to facilitate connecting a light shade to an electrical socket without damaging the light shade.

DETAILED DESCRIPTION

Figure 1:
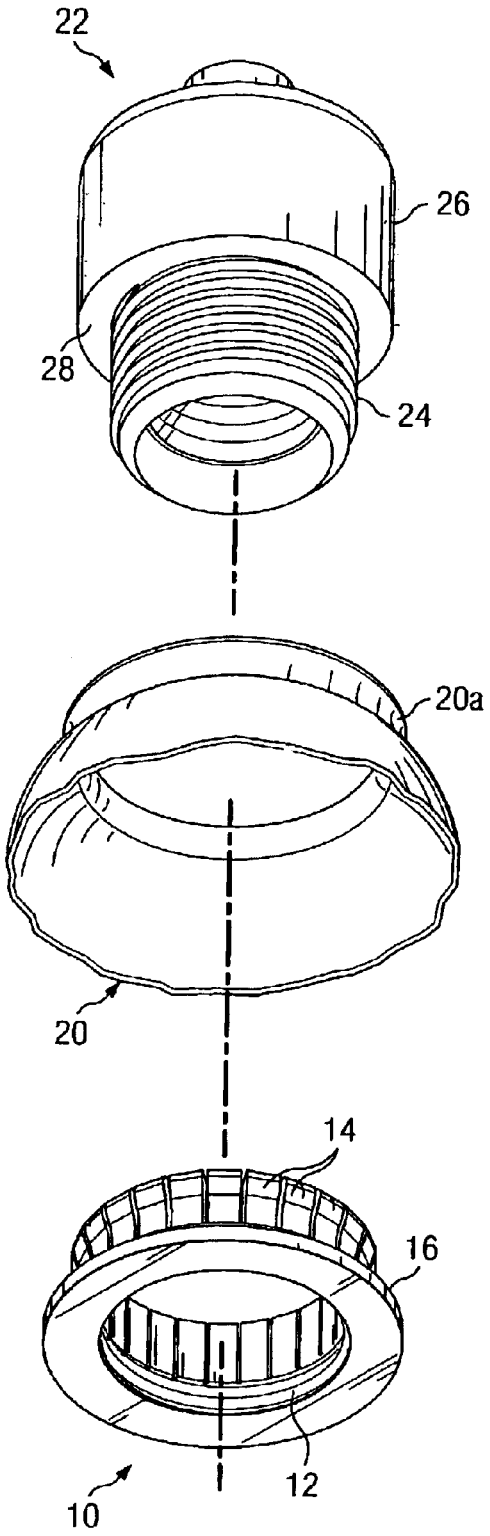
FIG. 1 is an exploded, isometric view of an adapter according to an embodiment of the present invention shown with an electrical socket and a light shade.
Figure 2:
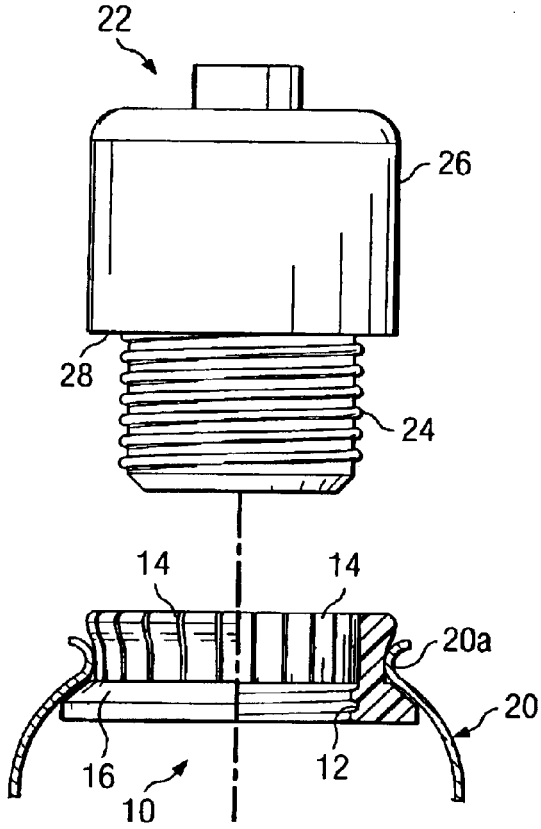
FIG. 2 is a view similar to that of FIG. 1 but showing the adapter connected to the shade.

Referring to FIGS. 1 and 2 of the drawings, the reference 10 refers, in general, to an adapter according to an embodiment of the present invention. The adapter 10 includes an internally threaded annular base member 12 having a plurality of angularly-spaced ribs 14 extending from one end thereof which function as leaf springs in a manner to be described. The ribs 14 are spaced radially inwardly from the outer periphery of the base member to form an annular shoulder 16 which is beveled for reasons to be described.

The adapter 10 is designed to mount a light shade 20 to an electrical socket 22. The shade 20 is shown partially and can be formed by a translucent glass or plastic and has two open ends. The radius of curvature of the shade near one open end is reversed to form a neck 20*a*.

The electrical socket 22 has a cylindrical threaded portion 24 extending from a cylindrical base portion 26. The diameter of the threaded portion 24 is less than that of the base portion 26 to form a shoulder 28. The threaded portion 24 is both internally threaded to receive a light bulb (not shown), and externally threaded to receive the internally threaded base member 12 of the adapter 10. It is understood that the socket 22 is mounted to structure providing a source of electrical current, which could be a light assembly, ceiling fan, an electrical box mounted on a wall or ceiling, or the like, and that proper electrical connections would be connected to the socket 22, all in a conventional manner.

To connect the shade 20 to the socket 22 as shown in FIG. 2, the adapter 10 is inserted through the other end opening of the shade and into the open end of the shade adjacent the neck 20*a*, and is aligned relative to the shade so that the ribs 14 are centered in the latter opening. The adapter 10 is then forced through the latter opening so that the ribs 14 engage the inner surface of the neck 20*a*. The outer circumference formed by the outer surfaces of the ribs 14 is slightly greater than the inner surface of the flange neck 20*a* so that the neck engages the ribs in a force fit and may even force the ribs slightly radially inwardly. In the connected position of FIG. 2, the inner surface of the end portion of the shade 20 adjacent the neck 20a engages the beveled portion of the shoulder 16.

Figure 3:
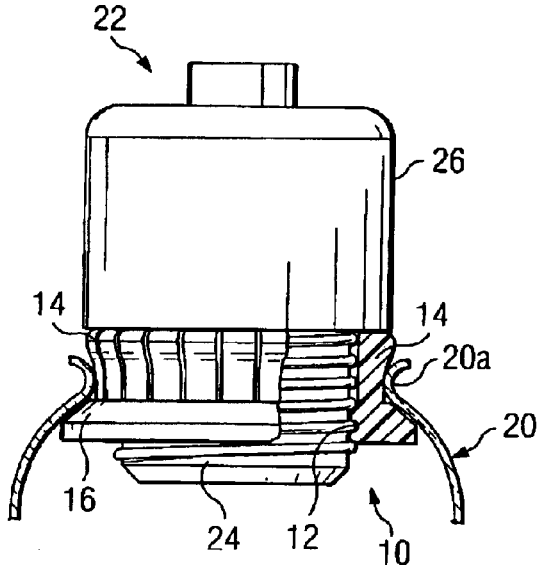
FIG. 3 is a view similar to that of FIG. 1 but depicting the components of FIG. 1 in a fully assembled condition.

The adapter 10, with the shade 20 connected to it in the manner described above, is then positioned adjacent the socket 22 so that the internally threaded base portion 12 of the adapter is aligned with the externally threaded portion 24 of the socket. The adapter 10 is then moved into engagement with the socket 22 and rotated to cause it to axially advance relative to the socket until the distal ends of the ribs 14 butt the shoulder 28 of the socket, as shown in FIG. 3, to lock the shade 20 relative to the socket 22. A light bulb (not shown) can then be inserted through the shade 20 and threaded into the internally threaded portion of the socket portion 24 to complete the installation.

Figure 4:
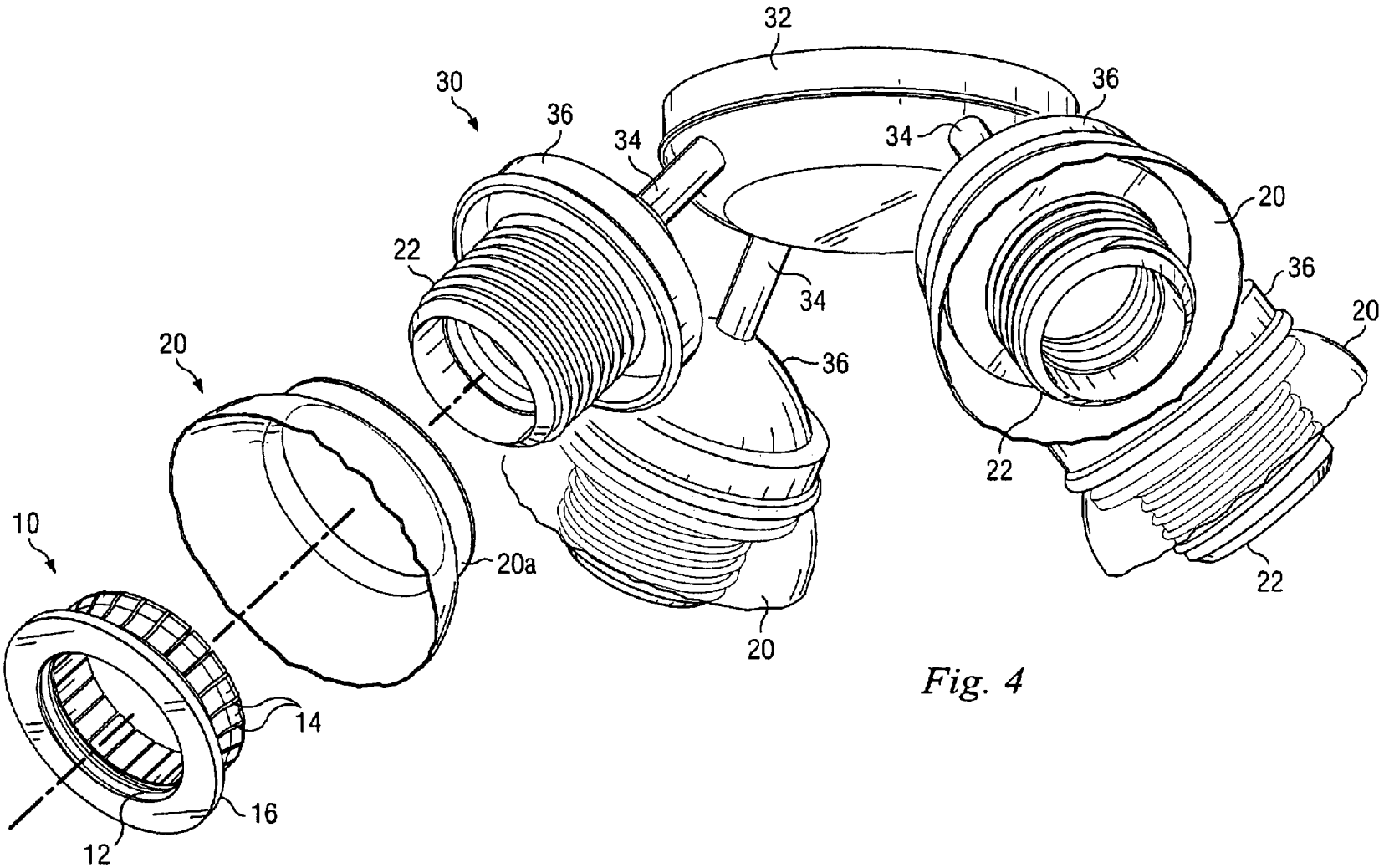
FIG. 4 is an isometric view of a light assembly that utilizes the adapter of FIGS. 1–3.

FIG. 4 depicts a typical application of the adapter 10 which is for use with a light fixture 30. The fixture 30 includes a base 32 which can be mounted to a wall, a ceiling, a ceiling fan, or the like, in any conventional manner. Four stems, or tubes, 34 (three of which are shown) extend from the base 32. The stems 34, as well as the socket 22, are connected to a skirt 36 in any conventional manner. It is understood that electrical conductors (not shown) extend from the wall, ceiling, ceiling fan, or the like, through the base 32, the stems 34, and the skirts 36 where they are connected to the sockets 22 to provide electrical power to the light bulbs (not shown) connected to the sockets in the manner described above. The adapters 10 connect the shades 20 to the sockets 22 in the manner described above. As in the previous drawings, the shades 20 are shown only partially, it being understood that their axial length is sufficient to extend past their corresponding sockets 22 and the light bulbs connected to the sockets.

Thus, the adapter 10 is easy to use, and facilitates connecting the light shade 20 to the socket 22 in a quick and easy manner without any danger of damage to the shade.

It is understood that variations may be make in the above without departing from the scope of the invention. For example, the adapter 10 is not limited to the specific application shown in FIG. 4, but can be used with any type of fixture requiring a shade to be connected to a socket. In fact the socket 22 can extend directly from a wall, a ceiling, a fan, or any structure. Also, the number and/or shape of the ribs 14 can be varied and the shape of the shades 20 can be varied. Further, the number of sockets 22 and shades 20 in the fixture of FIG. 4 can be varied. Moreover, it is understood that spatial references, such as "axially", "radially", "adjacent", etc. are for the purpose of example only and do not limit the specific orientation or location of the structure described above.

The foregoing description of a specific embodiment of the present invention has been presented for purposes of illustration and description and is not intended to be exhaustive or to limit the invention to the precise forms disclosed. Many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An adapter for connecting a light shade to an electrical socket comprising an internally threaded base member adapted to threadedly engage an externally threaded member of the socket, and a plurality of angularly-spaced ribs extending from the base member and adapted to extend through an opening in the shade in a force fit.

2. The adapter of claim 1 wherein the ribs are spaced radially inwardly from the outer periphery of the base member to form an annular shoulder which engages the corresponding inner surface of the shade.

3. The assembly of claim 2 wherein the shade has a neck defining the opening of the shade and extending over the shoulder of the adapter.

4. The adapter of claim 2 wherein the shoulder is beveled to facilitate the engagement with the inner surface.

5. The adapter of claim 1 wherein each rib forms a leaf spring.

6. The adapter of claim 1 wherein the shade forces the ribs slightly radially inwardly.

7. The adapter of claim 1 wherein the base member has an internally threaded portion for receiving a light bulb.

8. An electrical light assembly comprising:

an electrical socket having an externally threaded cylindrical member;

a light shade having an opening; and an adapter comprising:

an internally threaded base member adapted to threadedly engage the externally threaded portion of the socket, and a plurality of angularly-spaced ribs extending from the base member and adapted to extend through the opening in the shade in a force fit.

9. The assembly of claim 8 wherein the ribs are spaced radially inwardly from the outer periphery of the base member to form an annular shoulder which engages the corresponding inner surface of the shade.

10. The assembly of claim 9 wherein the shade comprises a neck defining the opening of the shade and extending over the shoulder of the adapter.

11. The assembly of claim 9 wherein the shoulder is beveled to facilitate the engagement with the inner surface.

12. The assembly of claim 8 wherein each rib forms a leaf spring.

13. The assembly of claim 12 wherein the shade forces the ribs slightly radially inwardly.

14. The assembly of claim 8 wherein the base member has an internally threaded portion for receiving a light bulb.

15. A method of connecting a light shade to an electrical socket, the method comprising forcing a plurality of angularly-spaced ribs extending from a base member of an adapter through an opening in the shade to establish a force fit, and threadedly engaging the base member of the adapter to the socket.

16. The method claim 15 further comprising spacing the ribs radially inwardly from the outer periphery of the base member to form an annular shoulder which engages the corresponding inner surface of the shade.

17. The method of claim 16 further comprising providing a neck on the shade that defines the opening in the shade and extends over the shoulder.

18. The method of claim 16 further comprising beveling the shoulder to facilitate the engagement with the inner surface.

19. The method of claim 15 further comprising forcing the ribs radially inwardly by the shade.

20. The method of claim 15 further comprising receiving a light bulb in the internally threaded portion of the base member.

21. An adapter for connecting a light shade to an electrical socket comprising means for threadedly engaging an externally threaded member of the socket, and means extending from the first-mentioned means for extending through an opening in the shade in a force fit.

22. The adapter of claim 21 wherein the first-mentioned means is internally threaded.

23. The adapter of claim 21 wherein the second-mentioned means is a plurality of angularly-spaced ribs.

* * * * *